US007379082B2

(12) United States Patent
Jo et al.

(10) Patent No.: US 7,379,082 B2
(45) Date of Patent: May 27, 2008

(54) METHOD AND APPARATUS FOR CONTROLLING IN THERMAL PRINTER

(75) Inventors: Gyeong-hun Jo, Suwon-si (KR); Jin-tae Chung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 241 days.

(21) Appl. No.: 11/281,484

(22) Filed: Nov. 18, 2005

(65) Prior Publication Data

US 2006/0109337 A1 May 25, 2006

(30) Foreign Application Priority Data

Nov. 19, 2004 (KR) ..... 10-2004-0095061

(51) Int. Cl.
*B41J 2/38* (2006.01)

(52) U.S. Cl. ..... 347/186

(58) Field of Classification Search ..... 347/185, 347/186; 400/120.08
See application file for complete search history.

(56) References Cited

U.S. PATENT DOCUMENTS 5,220,350 A 6/1993 Fujii
5,237,338 A 8/1993 Stephenson
5,381,164 A * 1/1995 Ono ..... 347/186
5,451,988 A * 9/1995 Ono ..... 347/185
5,963,241 A * 10/1999 Higa et al. ..... 347/186
6,744,455 B2 * 6/2004 Coons et al. ..... 347/189

FOREIGN PATENT DOCUMENTS

| | | |
|---|---|---|
| EP | 1 338 429 A2 | 8/2003 |
| EP | 1 338 429 A3 | 7/2004 |
| JP | 56-169074 | 12/1981 |
| JP | 02-045182 | 2/1990 |
| JP | 02-169263 | 6/1990 |
| JP | 03-051149 | 3/1991 |
| JP | 07-068826 | 3/1995 |
| JP | 07-089114 | 4/1995 |
| JP | 08-025679 | 1/1996 |
| JP | 10-264423 | 10/1998 |
| JP | 11-291526 | 10/1999 |
| JP | 2001-219588 | 8/2001 |
| JP | 2004-142357 | 5/2004 |
| KR | 1996-0021541 | 7/1996 |
| KR | 10-2000-0050350 A | 8/2000 |
| WO | WO 94/19197 | 9/1994 |

* cited by examiner

*Primary Examiner*—Huan Tran
(74) *Attorney, Agent, or Firm*—Roylance, Abrams, Berdo & Goodman, LLP

(57) ABSTRACT

A system and method is provided for controlling printing in a thermal printer which includes measuring a temperature of a thermal printhead (TPH), heating the TPH by applying a TPH driving strobe pulse when the temperature of the TPH is lower than a first set temperature, and printing on a thermal reactive paper when the temperature of the TPH is equal to or greater than the first set temperature.

17 Claims, 3 Drawing Sheets

METHOD AND APPARATUS FOR CONTROLLING IN THERMAL PRINTER

CROSS-REFERENCE TO RELATED APPLICATIONS

This application claims the benefit under 35 U.S.C. §119 (*a*) of Korean Patent Application No. 10-2004-0095061, filed in the Korean Intellectual Property Office on Nov. 19, 2004, the entire disclosure of which is incorporated herein by reference.

BACKGROUND OF THE INVENTION

1. Field of the Invention

The present invention relates to a method and apparatus for controlling printing in a thermal printer. More specifically, the present invention relates to a method and apparatus for controlling printing in a thermal printer while maintaining a temperature of a thermal printhead (TPH) for applying a predetermined heat to a double-sided thermal reactive paper.

2. Description of the Related Art

Thermal printers include a number of devices which typically use print paper (hereinafter, referred to as "thermal reactive paper") which displays a predetermined color by reacting to heat, and include a number of devices which typically use an ink ribbon which transfers a predetermined color to the paper by reacting to heat for printing. The devices using the ink ribbon require an additional apparatus for driving the ink ribbon so that the structure thereof is complicated and a final product is expensive. Also, since the ink ribbon is provided as a consumable product, it needs to be continuously replaced, such that resulting printing costs per page are high.

FIG. 1 is a sectional view of a typical thermal reactive paper. Referring to FIG. 1, a thermal reactive paper 10 has ink layers 12 and 13 of a predetermined color formed on first and second surfaces of a base sheet 11, respectively. Each of the ink layers 12 and 13 may have a monolayer structure comprised of a single color ink, or a multilayered structure for the display of two or more colors. For example, the ink layer 12 on the first surface of the base sheet 11 may have two layers for the display of magenta (M) and cyan (C) colors, while the ink layer 13 on the second surface may have a single layer for the display of a yellow (Y) color. The base sheet 11 is a transparent material. Additional details of thermal reactive paper are disclosed in U.S. Patent Application Publication No. 2003-0125206 of Bhatt et al., entitled "Thermal Imaging System", the entire disclosure of which is incorporated herein by reference.

A thermal printer using the thermal reactive paper 10 typically comprises a thermal printhead (TPH) where a plurality of heating elements are arranged at a predetermined resolution in a widthwise direction of the thermal reactive paper 10. After printing is performed with respect to both sides of the thermal reactive paper 10, a color image appears on the thermal reactive paper as viewed from one side of the thermal reactive paper 10.

The quality of a color image of the thermal printer is greatly dependent on the temperature of the TPH, such that the temperature of the TPH should be maintained at a substantially constant value during printing. In particular, when the printer is in a ready mode or prints the first page, if the temperature of the TPH is lower than the minimum target temperature, the color of the ink layer of the thermal reactive paper is insufficiently displayed. Thus, spots may be formed on the thermal reactive paper.

To make the temperature of the TPH reach a value that is greater than the temperature of the minimum target temperature, the TPH needs to be preheated. Japanese Patent Laid-open No. 1996-25679, the entire disclosure of which is incorporated herein by reference, discloses a structure to increase the temperature of a printhead by installing a generating device and a temperature sensor at a support portion for supporting the heating elements and heating the generating device according to the temperature of the printhead. Japanese Patent Laid-open No. 2004-142357, the entire disclosure of which is incorporated herein by reference, further discloses a structure including a printhead, a temperature sensor, a cooling fan, and a heater to constantly maintain the temperature of the TPH.

However, a need remains for a system and method for effectively and efficiently controlling printing such that the temperature of a printhead of a thermal printer is maintained in a particular range.

SUMMARY OF THE INVENTION

To substantially solve the above and other problems, the present invention provides a method and apparatus for controlling printing such that the temperature of a printhead of a thermal printer is maintained in a particular range.

The present invention provides a method and apparatus for controlling printing which increases the temperature of a printhead in a process of preparing for printing.

According to an aspect of the present invention, a method for controlling printing in a thermal printer is provided and comprises the steps of measuring a temperature of a thermal printhead (TPH), heating the TPH by applying a TPH driving strobe pulse when the temperature of the TPH is less than a first set temperature, and printing on a thermal reactive paper when the temperature of the TPH is equal to or greater than the first set temperature.

The step of measuring the temperature of the TPH is performed at a predetermined interval while in a print mode.

The step of heating the TPH comprises the step of separating the TPH from a transfer path of the thermal reactive paper to prevent the TPH from contacting the thermal reactive paper when the thermal reactive paper is transferred to the print path.

The step of heating the TPH further comprises the step of applying a maximum strobe pulse to the TPH.

The step of heating the TPH still further comprises the step of notifying a user of the preheating of the TPH.

The step of printing on the thermal reactive paper comprises the step of cooling the TPH when the temperature of the TPH is greater than a second set temperature that is greater than the first set temperature.

The step of printing on the thermal reactive paper further comprises the step of warning the user that the temperature of the TPH is high.

According to another aspect of the present invention, an apparatus for controlling printing in a thermal printer is provided and comprises a temperature sensor for measuring a temperature of a thermal printhead (TPH) at a predetermined interval, and a control portion for heating the TPH by applying a TPH driving strobe pulse when the temperature of the TPH is less than a first set temperature, and printing on a thermal reactive paper when the temperature of the TPH is equal to or greater than the first set temperature.

The apparatus further comprises a TPH elevating portion for separating the TPH from a transfer path of the thermal reactive paper, wherein the control portion preheats the TPH and drives the TPH elevating portion to prevent the TPH from contacting the thermal reactive paper when the thermal reactive paper is transferred to the print path.

The apparatus further comprises a cooling fan for cooling the TPH, wherein the cooling fan is driven when the temperature of the TPH is greater than a second set temperature that is greater than the first set temperature.

The apparatus further comprises a display portion for displaying a printing control state, wherein the control portion displays a warning on the display portion that the temperature of the TPH is greater than the second set temperature.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

Figure 1:
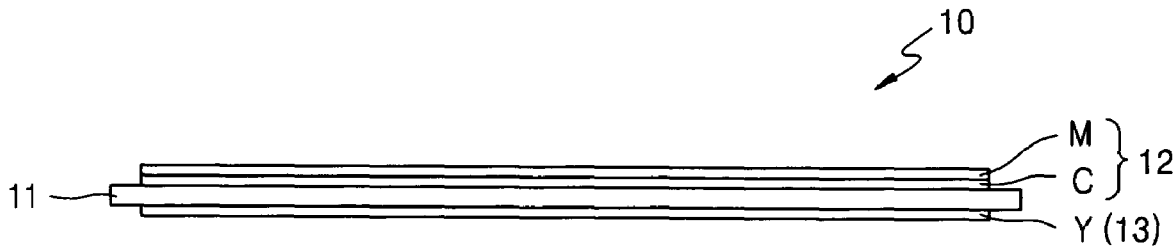
FIG. 1 is a sectional view of a typical thermal reactive paper.
Figure 2:
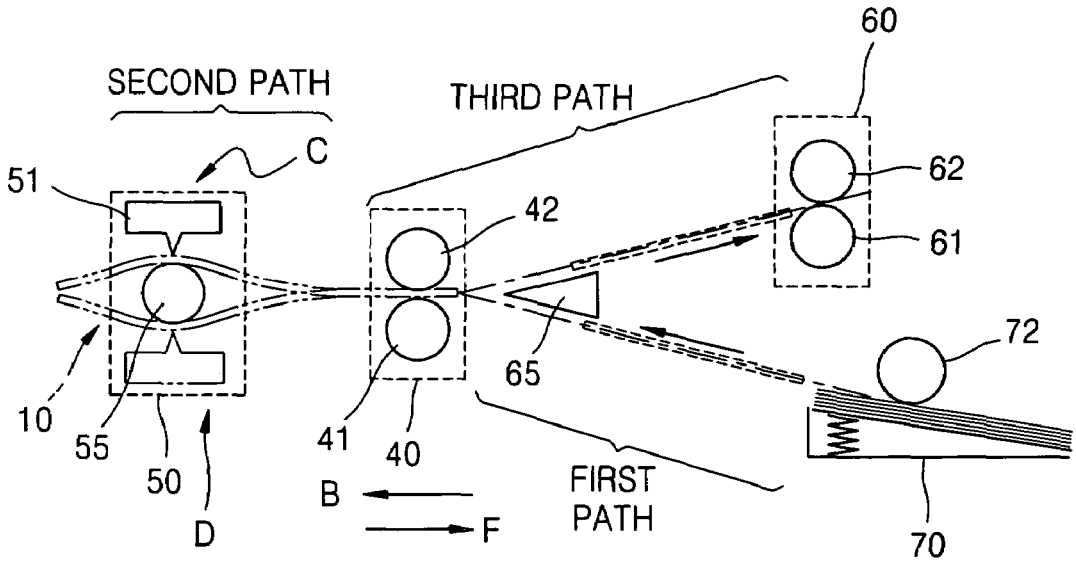
FIG. 2 is a view illustrating a thermal printer using a method for controlling printing according to an embodiment of the present invention.

FIG. 2 is a view illustrating a thermal printer using a method for controlling printing according to an embodiment of the present invention. Referring to FIG. 2, a thermal printer comprises at least first, second and third paths along which a thermal reactive paper 10 is transferred. The first path is a paper supply path along which the thermal reactive paper 10 is transferred to the second path. Along the second path, the thermal reactive paper 10 is fed backward in a direction B for preparation of printing on the thermal reactive paper 10, and forward in direction F for printing. The third path is a path where the thermal reactive paper 10 being printed is located, and is also a path along which the thermal reactive paper 10 having only a first surface printed returns to the second path and where the thermal reactive paper 10 having the first and second surfaces printed is finally discharged.

A paper guide 65 is provided between the first and third paths. The paper guide 65 guides the thermal reactive paper 10 to proceed from the first path to the second path, and from the second path to the third path. Also, the paper guide 65 prevents the thermal reactive paper 10 from proceeding from the second path to the first path, so that the thermal reactive paper 10 from the second path proceeds only to the third path. The thermal reactive paper 10 from the first path is guided by the paper guide 65 to proceed to the second path.

The formation of an image is performed by an image forming portion 50 in the second path. The image formation can be performed two or more times when needed. However, in an exemplary embodiment of the present invention shown, the image formation is performed one time for each of the first and second surfaces, thus forming a total of two times. Prior to the image forming on the first and second surfaces of the thermal reactive paper 10, a thermal printhead (TPH) 51 and a platen roller 55 of the image forming portion 50 need to be located at a predetermined position. That is, for example, when an image is to be formed on the first surface of the thermal reactive paper 10, the TPH 51 is located at a position C. When an image is to be formed on the second surface of the thermal reactive paper 10, the TPH 51 is rotated to be located at a position D.

Figure 3:
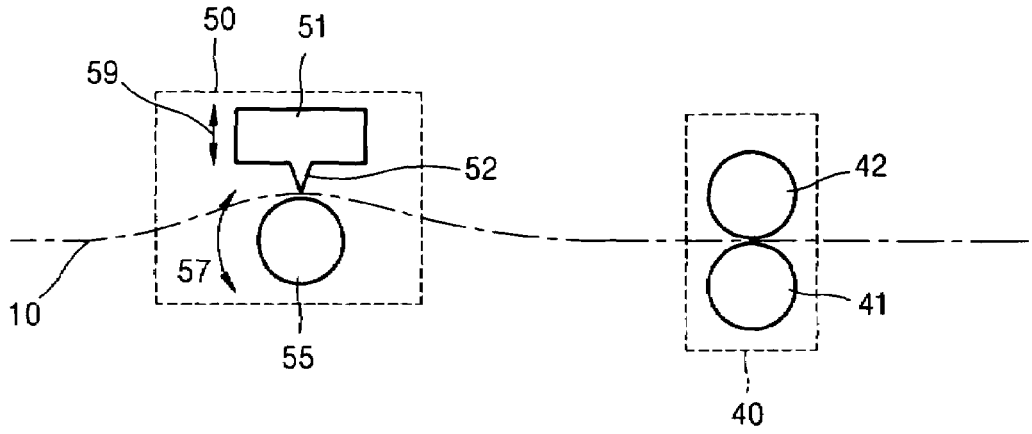
FIG. 3 is a view illustrating a portion of the thermal printer of FIG. 2 in greater detail.

Referring to FIGS. 2 and 3, the TPH 51 is rotated around a rotation shaft (not shown) of the platen roller 55 by a TPH rotation unit 57. The change of the position of the TPH 51 is performed when there is no interference with the thermal reactive paper 10, for example, before the thermal reactive paper 10 is supplied from the first path or when the thermal reactive paper 10 is transferred to the third path after the image is formed on the first surface and before being returned to the second path.

When the thermal reactive paper 10 having the image formed on the first surface is fed back to the second path, another image is formed on the second surface by the TPH 51 which has since changed positions. In this process, the thermal reactive paper 10 is gradually moved forward by a transfer portion 40. After the image formation with respect to the second surface is completed, the thermal reactive paper 10 further proceeds along the second and third paths and is discharged through a paper discharge portion 60. The transfer portion 40 comprises a feeding roller 41 for transferring the thermal reactive paper 10 and an idle roller 42 for pressing the thermal reactive paper 10 entering between the feeding roller 41 and the idle roller 42 toward the feeding roller 41.

To allow the thermal reactive paper 10 to easily pass between the TPH 51 and the platen roller 55 when the thermal reactive paper 10 is fed back, the TPH 51 is separated by a predetermined distance, for example, 1-2 mm, from the platen roller 55 using a TPH elevating portion 59 during printing.

Reference numeral 70 denotes a paper storing portion and reference numeral 72 denotes a pickup roller for supplying paper.

The paper discharge portion 60 comprises a discharge roller 61 and an idle roller 62. The discharge roller 61 and the pickup roller 72 can be configured as a single roller serving both functions.

Figure 4:
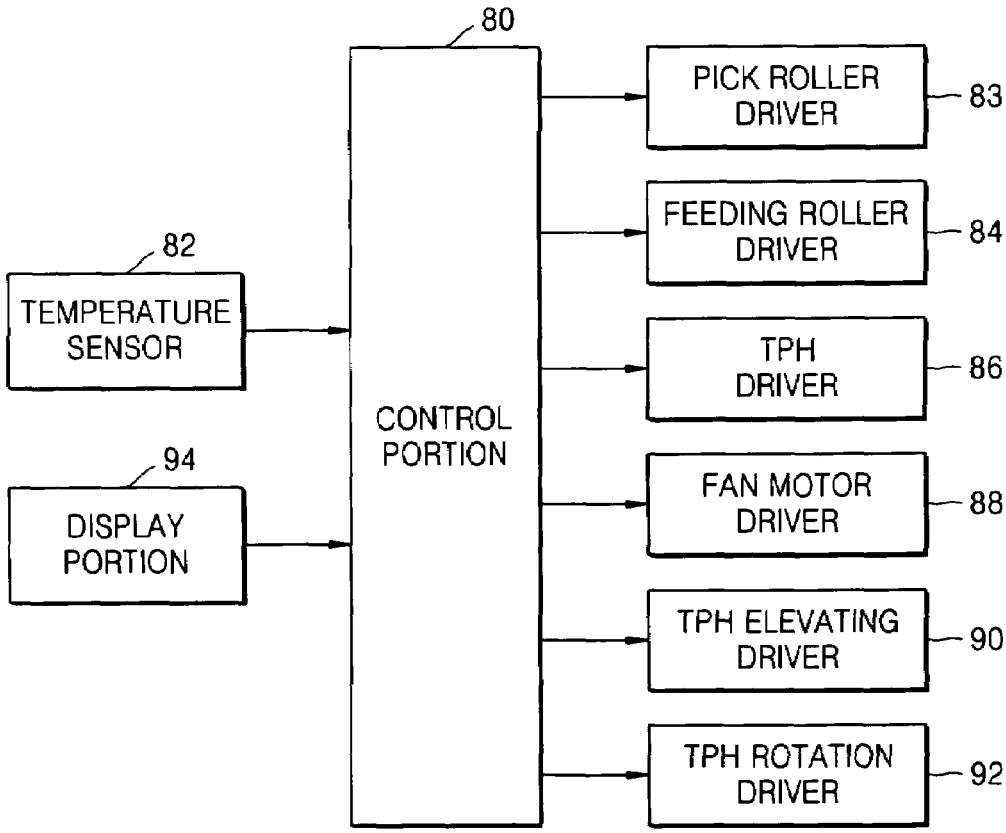
FIG. 4 is a block diagram illustrating a configuration of a print control apparatus using a print control method for the thermal printer according to an embodiment of the present invention.

FIG. 4 is a block diagram illustrating a configuration of a print control apparatus using a print control method for a thermal printer according to an embodiment of the present invention. Referring to FIG. 4, a print control apparatus comprises a control portion 80, a temperature sensor 82, a pickup roller driver 83, a feeding roller driver 84, a TPH driver 86, a fan motor driver 88, a TPH elevating driver 90, a TPH rotation driver 92 and a display portion 94.

The control portion 80 compares a current temperature of the TPH 51 measured by the temperature sensor 82 with a set temperature stored in a memory (not shown) and controls the pickup roller driver 83, feeding roller driver 84, TPH driver 86, and fan motor driver 88. Also, in a print preparation step of the thermal reactive paper 10, the control portion 80 controls the TPH elevating driver 90 and the TPH rotation driver 92.

An exemplary method of controlling printing of a direct thermal printer according to an embodiment of the present invention will now be described below with reference to the accompanying drawings.

Figure 5:
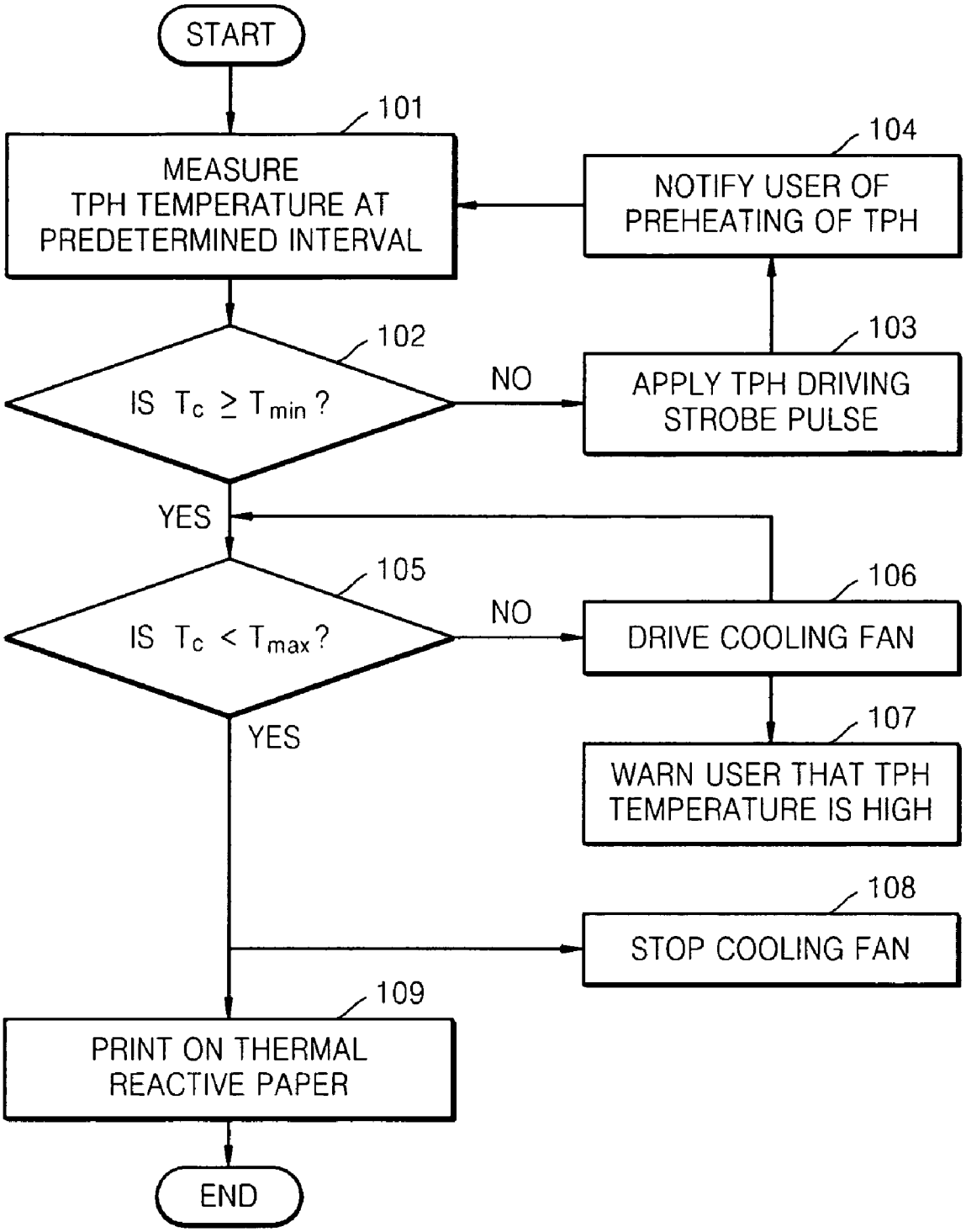
FIG. 5 is a flow chart for illustrating a print control method for a thermal printer according to an embodiment of the present invention.

FIG. 5 is a flow chart for illustrating a print control method for a thermal printer according to an embodiment of the present invention. First, in a print mode in which a print signal is input to the printer, the control portion 80 measures the temperature of the TPH 51 at a predetermined interval, for example, every 100 ms at step (101).

It is then determined whether the measured TPH temperature Tc is equal to or greater than a first set temperature Tmin at step (102). The TPH temperature Tc is measured by the temperature sensor 82 installed at the TPH 51. The first set temperature Tmin can be a minimum temperature for providing a color of the ink layer of the thermal reactive paper.

In step (102), when the TPH temperature Tc is determined to be less than the first set temperature Tmin, a TPH driving strobe pulse is applied to the TPH driver 86 at step (103). The TPH driving strobe pulse width can be adjusted according to the TPH temperature Tc. A full range pulse is applied for the quick heating of the TPH 51. The heating of the TPH 51 is displayed on the display portion 94 at step (104) and steps (101) and (102) are repeated.

When the TPH temperature Tc is determined to be equal to or greater than the first set temperature Tmin at step (102), it is then determined whether the TPH temperature Tc is less than a second set temperature Tmax at step (105). The second set temperature Tmax is greater than the first set temperature Tmin and denotes a level at which the TPH 51 could become overheated.

When the TPH temperature Tc is determined to be greater than the second set temperature Tmax at step (105), the fan motor driver 88 drives a cooling fan (not shown) to cool the TPH 51 at step (106). This is to prevent the heating device 52 of the TPH 51 from being overheated. The user is warned of the TPH overheated state at step (107). For example, a message that the TPH has become overheated can be displayed on the display portion 94.

When the TPH temperature Tc is determined to be less than the second set temperature Tmax at step (105), the operation of the cooling fan is stopped at step (108) and printing on the thermal reactive paper 10 is completed at step (109).

In the processes of steps (101) through (107), the thermal reactive paper 10 is picked up and transferred by the pickup roller 72 and the feeding roller 41 so as to be arranged in a print ready state. The TPH 51 is separated from the platen roller 55 by controlling the TPH elevating driver 90 so that the thermal reactive paper 10 being transferred to a print path does not contact the TPH 51 that is heated.

As described above, according to the printing control method of a thermal printer according to embodiments of the present invention, when the temperature of the TPH is excessively low in a ready mode or a print initial mode, the TPH can be preheated to a predetermined temperature by applying a driving strobe pulse to the TPH without using an additional heater. Also, since the TPH can be heated in the step of preparing the paper of the thermal printer, additional heating time is not needed. Furthermore, since the space between the TPH and the paper that is fed back during the preheating of the TPH is maintained, the maximum strobe pulse can be output to the TPH so that a preheating time can be reduced. In addition, when the measured TPH temperature is excessively high, the fan is driven to lower the temperature so that the overheating of the heating apparatus can be prevented.

While this invention has been particularly shown and described with reference to certain exemplary embodiments thereof, it will be understood by those skilled in the art that various changes in form and details may be made therein without departing from the spirit and scope of the invention as defined by the appended claims.

What is claimed is:

1. A method for controlling printing in a thermal printer, comprising the steps of:

measuring a temperature of a thermal printhead (TPH);

heating the TPH by applying a variable width TPH driving strobe pulse when the temperature of the TPH is less than a first set temperature; and printing on a thermal reactive paper when the temperature of the TPH is equal to or greater than the first set temperature.

2. The method as claimed in claim 1, wherein the step of measuring the temperature of the TPH is performed at a predetermined interval while in a print mode.

3. The method as claimed in claim 1, wherein the step of heating the TPH comprises the step of:

separating the TPH from a transfer path of the thermal reactive paper to prevent the TPH from contacting the thermal reactive paper when the thermal reactive paper is transferred to the print path.

4. The method as claimed in claim 3, wherein the step of heating the TPH further comprises the step of applying a maximum strobe pulse to the TPH.

5. The method as claimed in claim 1, wherein the step of heating the TPH comprises the step of notifying a user of the preheating of the TPH.

6. The method as claimed in claim 5, wherein the step of printing on the thermal reactive paper comprises the step of:

cooling the TPH when the temperature of the TPH is greater than a second set temperature that is greater than the first set temperature.

7. The method as claimed in claim 6, wherein the step of cooling the TPH comprises the step of driving a cooling fan.

8. The method as claimed in claim 1, wherein the step of printing on the thermal reactive paper comprises the step of warning the user that the temperature of the TPH is high.

9. An apparatus for controlling printing in a thermal printer, comprising:

a temperature sensor for measuring a temperature of a thermal printhead (TPH) at a predetermined interval; and a control portion for controlling heating of the TPH by applying a variable width TPH driving strobe pulse when the temperature of the TPH is less than a first set temperature and for controlling printing on a thermal reactive paper when the temperature of the TPH is equal to or greater than the first set temperature.

10. The apparatus as claimed in claim 9, further comprising:

a TPH elevating portion for separating the TPH from a transfer path of the thermal reactive paper, wherein the control portion is configured to control preheating of the TPH and driving of the TPH elevating portion to prevent the TPH from contacting the thermal reactive paper when the thermal reactive paper is transferred to the print path.

11. The apparatus as claimed in claim 9, further comprising:

a cooling fan for cooling the TPH, wherein the cooling fan is driven when the temperature of the TPH is greater than a second set temperature that is greater than the first set temperature.

12. The apparatus as claimed in claim 9, further comprising:

a display portion for displaying a printing control state, wherein the control portion displays a warning on the display portion that the temperature of the TPH is greater than the second set temperature.

13. A computer program embodied on a computer-readable medium for controlling printing in a thermal printer, comprising:

a first set of instructions for controlling a device for measuring a temperature of a thermal printhead (TPH);

a second set of instructions for controlling a device for heating the TPH by applying a variable width TPH driving strobe pulse when the temperature of the TPH is less than a first set temperature; and a third set of instructions for controlling a device for printing on a thermal reactive paper when the temperature of the TPH is equal to or greater than the first set temperature.

14. The computer program embodied on a computer-readable medium as claimed in claim 13, wherein the temperature of the TPH is measured at a predetermined interval.

15. The computer program embodied on a computer-readable medium as claimed in claim 13, further comprising:

a fourth set of instructions for controlling a device for separating the TPH from a transfer path of the thermal reactive paper to prevent the TPH from contacting the thermal reactive paper when the thermal reactive paper is transferred to the print path.

16. The computer program embodied on a computer-readable medium as claimed in claim 13, further comprising a fifth set of instructions for controlling a device for notifying a user of the preheating of the TPH.

17. The computer program embodied on a computer-readable medium as claimed in claim 13, further comprising:

a sixth set of instructions for controlling a device for cooling the TPH when the temperature of the TPH is greater than a second set temperature that is greater than the first set temperature and warning the user that the temperature of the TPH is high.

* * * * *